US010167881B2

(12) United States Patent
Biwersi

(10) Patent No.: US 10,167,881 B2
(45) Date of Patent: Jan. 1, 2019

(54) VALVE COMPONENTS

(71) Applicant: HYDAC TECHNOLOGY GMBH, Salzbach/Saar (DE)

(72) Inventor: Sascha Alexander Biwersi, Mettlach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 21 days.

(21) Appl. No.: 14/912,419

(22) PCT Filed: Sep. 2, 2014

(86) PCT No.: PCT/EP2014/002382
§ 371 (c)(1),
(2) Date: Feb. 17, 2016

(87) PCT Pub. No.: WO2015/032492
PCT Pub. Date: Mar. 12, 2015

(65) Prior Publication Data

US 2016/0201695 A1 Jul. 14, 2016

(30) Foreign Application Priority Data

Sep. 3, 2013 (DE) ..... 10 2013 014 671

(51) Int. Cl.
*F15B 13/02* (2006.01)
*F15B 13/00* (2006.01)
*F15B 13/04* (2006.01)

(52) U.S. Cl.
CPC ..... *F15B 13/0417* (2013.01); *F15B 13/026* (2013.01); *F15B 13/0402* (2013.01); *F15B 2013/008* (2013.01)

(58) Field of Classification Search
CPC ..... F15B 13/0417; F15B 13/026; F15B 13/0402; F15B 2013/008
(Continued)

(56) References Cited

U.S. PATENT DOCUMENTS 3,181,386 A 5/1965 Schaefer
4,667,930 A 5/1987 Latimer et al.
(Continued)

FOREIGN PATENT DOCUMENTS

DE 26 04 208 8/1977
DE 40 40 603 6/1992
(Continued)

OTHER PUBLICATIONS

International Search Report (ISR) dated Jun. 15, 2015 in International (PCT) Application No. PCT/EP2014/002382.

*Primary Examiner* — Marina Tietjen
(74) *Attorney, Agent, or Firm* — Wenderoth, Lind & Ponack, L.L.P.

(57) ABSTRACT

A first valve component (10), in particular a pressure compensator component, has a valve slide (16) that can be guided in a valve housing (12) in a longitudinal direction. The valve slide has a control part (34) controlling a fluid-conducting connection (28) between at least two fluid connection points (30, 32) in the valve housing (12). The control part has at least one pocket-shaped recess (38), at least part of which is bordered by a fluid-guiding surface (40) extending at least between two vertices of the recess and extending with increasing inclination from one vertex to another vertex. Starting from a predeterminable distance before the other vertex, the fluid-guiding surface (40) extends from its point of greatest inclination with decreasing inclination in the direction of the other vertex.

8 Claims, 3 Drawing Sheets

(58) Field of Classification Search
USPC ..... 251/318; 137/625.69
See application file for complete search history.

(56) References Cited

U.S. PATENT DOCUMENTS

| | | | | |
|---|---|---|---|---|
| 4,739,797 | A | 4/1988 | Scheffel | |
| 4,862,920 | A * | 9/1989 | Cleasby | F15B 13/04 137/625.3 |
| 5,138,837 | A | 8/1992 | Obertrifter et al. | |
| 5,682,744 | A * | 11/1997 | Hasegawa | B62D 5/087 137/625.3 |
| 6,135,149 | A | 10/2000 | Nozawa et al. | |
| 6,397,890 | B1 | 6/2002 | Michelson et al. | |
| 6,450,194 | B1 * | 9/2002 | Wasson | F15B 13/0402 137/351 |
| 2002/0153204 | A1 | 10/2002 | Veletovac et al. | |
| 2006/0158025 | A1 | 7/2006 | Christensen et al. | |
| 2009/0071545 | A1 | 3/2009 | Xiang et al. | |
| 2009/0101854 | A1 | 4/2009 | Jeon | |
| 2010/0206413 | A1 | 8/2010 | Rüb | |
| 2012/0168274 | A1 | 7/2012 | Mills | |
| 2014/0026546 | A1 * | 1/2014 | Bacon | F16K 11/0708 60/325 |

FOREIGN PATENT DOCUMENTS

| | | |
|---|---|---|
| DE | 42 39 643 | 4/1993 |
| DE | 40 05 967 | 8/1994 |
| DE | 199 57 952 | 6/2001 |
| DE | 102 18 783 | 9/2003 |
| DE | 10 2005 002 699 | 7/2006 |
| DE | 10 2009 021 831 | 11/2010 |
| DE | 10 2010 053 805 | 6/2012 |
| EP | 0 200 182 | 11/1986 |
| EP | 0 967 398 | 12/1999 |
| EP | 1 500 825 | 1/2005 |
| EP | 2 053 253 | 4/2009 |
| JP | 10-132096 | 5/1998 |
| WO | 2009/062563 | 5/2009 |
| WO | 2010/042362 | 4/2010 |
| WO | 2011/031611 | 3/2011 |

* cited by examiner

VALVE COMPONENTS

FIELD OF THE INVENTION

The invention relates to a first valve component, conceived in particular as a pressure maintenance-type component, having a valve slide movably guided in a valve housing in a longitudinal direction. The valve slide has a control part for controlling a fluid-conducting connection between at least two fluid connection points accommodated in the valve housing. The control part has at least one pocket-shaped recess, at last part of which is bordered by a fluid-guiding surface extending at least between two vertices of the recess and having a slope that increases from one vertex to the other vertex.

The invention further relates to a second valve component, conceived in particular as a pressure maintenance-type component, having a valve slide movably guided in a valve housing in a longitudinal direction. The valve slide has two control parts for controlling a fluid-conducting connection between at least two fluid connection points accommodated in the valve housing. At least one control part has at least one pocket-shaped recess. The other control part in the non-actuated state is, by a guide part, in contact with an inner wall of the housing along which the valve slide is movably guided.

Also, the invention relates to a third valve component, conceived in particular as a pressure maintenance-type component, having a valve slide movably guided in a valve housing in a longitudinal direction. The valve slide has a first control part and a second control part for controlling a fluid-conducting connection between at least two fluid connection points accommodated in the valve housing. The second control part is, by a guide part, in contact with an inner wall of the housing along which the valve slide is movably guided. The valve slide is guided by another guide part through the inner wall of the valve housing in the region of the connection point serving as the fluid outlet therein. A fluid guide is arranged between the first and second control parts and holds these control parts apart.

BACKGROUND OF THE INVENTION

Such pressure maintenance-type components are known to the prior art in diverse forms of embodiments, in particular as integral components of directional control valves. For example, EP 1 500 825 A2 discloses a pressure maintenance valve with a valve slide that is movably guided in a longitudinal direction in a valve housing and that has a control part for controlling a fluid-conducting connection between at least two fluid connection points accommodated in the valve housing. The control part has at least one pocket-shaped recess, at least part of which is bordered by a fluid-guiding surface extending between at least two vertices of the recess and extending with an initially increasing and then constant slope from one vertex to the other vertex. The other vertex, which is arranged at the exit of the pocket-shaped recess, borders the edge or corner point of a right angle as a transition between the fluid-guiding surface and a collar surface of the valve slide or control slide. The collar surface extends perpendicular to the fluid-guiding surface.

The disadvantage with such pressure maintenance valves arises in that starting from the zero stroke, the progression of the active standard cross section increases quite abruptly over the opening stroke and has at least one kink in the further progression. Due to this progression of the standard cross section over the opening stroke, the control accuracy and the stability of the prior art pressure maintenance valves need improvement to increase the precision of the fluid control.

Because the prior art directional control valves with upstream or downstream pressure maintenance components must frequently fulfill a load-holding function, of which the geometric configuration is typically embodied by a circumferential vertical edge, effective compensation of the flow forces is thus complicated.

SUMMARY OF THE INVENTION

On the basis of the prior art, the invention addresses the problem of providing at least one valve component with improved control accuracy and increased stability that responds swiftly.

This problem is basically solved by a first valve component having one vertex and another vertex, where starting from a predeterminable distance from the other vertex, the fluid-guiding surface extends from its point of greatest slope with decreasing slope toward that vertex.

In this manner the pocket-shaped recess does not open at an edge, but transitions smoothly into a collar-shaped front surface (adjacent to the recess) of the control part as a component of the valve slide. The advantage of this structure is that the standard cross section does not change abruptly (as in the prior art) at an edge. The progression of the standard cross section over the opening stroke therefore does not have a kink, but instead, a continuous, monotonically increasing cross section with a very shallow initial slope is achieved over the opening stroke of the valve slide with its control part such that, in particular at the beginning of the opening process, a very high control accuracy prevails even over a relatively long opening stroke of the valve slide. Consequently, the control accuracy is considerably higher than with prior art solutions, and the stability of the control is likewise improved.

Preference is given, however, to the fluid-guiding surface having a continuous progression and a minimal incline or slope, preferably assuming the value of zero, at the respective other vertex. With a reverse arrangement of the vertices, however, there is the possibility of starting with the shallow slope at the bottom of the pocket and letting the fluid-guiding surface extend outwardly with increasing slope to the control collar. Particular preference is given to the fluid-guiding surface having a curved (S-shape) configuration and to the various gradients between the vertices being formed by the transition from a concave to a convex curve progression. In principle, however, the curve progression can be formed by other arc shapes, in particular semicircles. Such a rounded guiding surface also contributes to a continuous, "kink-free" control performance of the valve component. In particular, two adjacent fluid-guiding surfaces, which each merge into one another at the bottom of the pocket, form the boundary edge for this pocket.

In principle, however, the respective fluid-guiding surface can be formed by a plurality of sequentially arranged, planar surface sections. Each surface section preferably has a uniform slope that corresponds to the slope of the curve progression of the fluid-guiding surface in a middle area of the respective surface section. According to a development, the progression of the fluid-guiding surface can also be approximated iteratively by step-like subsections. The surfaces of the steps can be oriented coaxially or transversely to the longitudinal axis of the valve slide.

Advantageously, a plurality of pocket-shaped recesses can be arranged along the outer periphery of the control part of the valve slide such that the fluid-guiding surfaces between the individual vertices form a closed sine or cosine curve progression along this outer periphery. The progression of the guiding surfaces is correspondingly wave-shaped. The individual recesses merge into one another without any gap.

Advantageously, a groove-shaped recess connects to the bottom of a pocket-shaped recess in the region of a vertex, at least in a portion of the pocket-shaped recesses. These groove-shaped recesses offer the possibility of carrying out a fine-tuned control for the fluid volumes being conducted.

The largest opening cross section of the respective pocket-shaped recesses is oriented to the fluid connection point that serves as the fluid outlet of the valve housing. In this manner, the standard cross section can be continuously adapted to the increasing amounts of fluid as the opening stroke of the valve slide increases.

A second valve component of the invention is characterized in that the guide part has a switching edge surface extending in a step-shaped manner that faces the control part.

In this manner, a defined trailing edge is formed, at which the flow surface transitions from an annular transverse surface extending in the radial plane at an edge, into an outer peripheral surface extending coaxially to the longitudinal axis of the valve slide. An improvement of the sealing function inside the second valve component is achieved by the switching edge surface extending in a step-shaped manner. With the second valve component of the invention, a load-holding function is achievable for a pressure maintenance component or valve with simultaneous flow force compensation, which occurs in the case if the trailing edge is both a flow guide (in particular in the shape of a flow cone) and a defined vertical edge.

The switching edge surface extending in a step-shaped manner in the guide part of the second control part can be formed by a reduction in diameter between the outer peripheral side of the guide part and a preferably conically extending transition part of the valve slide in the direction of the first control part. A flow guide serving as a flow force compensator is formed by the conically extending transition part.

A third valve component of the invention is characterized in that another fluid guide is present, which fluid guide holds the second control part away from the second guide part.

A groove advantageously improves the flow dynamics of the second control part and facilitates the retraction of the valve slide. In addition, the sealing gap between the first guide part and the inner wall of the housing is reduced, which reduction favors the load holding function of the previously described second valve component.

The two fluid guides, which form axial spacings between the first control part and the second guide part as well as between the second control part and the second guide part, are obtained by groove-shaped, circumferential reductions in diameter in the valve slide. These reductions in diameter give rise to a wide, free, annular cross section through which the fluid can flow with minor pressure losses, which, due to low mass, likewise favors rapid control performance.

The valve slide can rest with one of its free front surfaces against an energy storage unit and can abut with its other free face against a volume space of variable volume, into which an inner channel of the valve slide opens with one of its ends. Another end is fluidically connected to the fluid guide between the two control parts. In this manner, the fluid pressure at the fluid inlet can be efficiently reproduced on the other free front surface. Additional difficult-to-drill boreholes in the valve housing are not needed.

A non-return function and a flow force compensator can be combined because the distance between the respective control edge and the trailing edge is sufficiently large. If this were not the case, a reasonably large stroke resolution of the control edge could not be combined with an effective flow force compensation.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

Figures 1, 2:
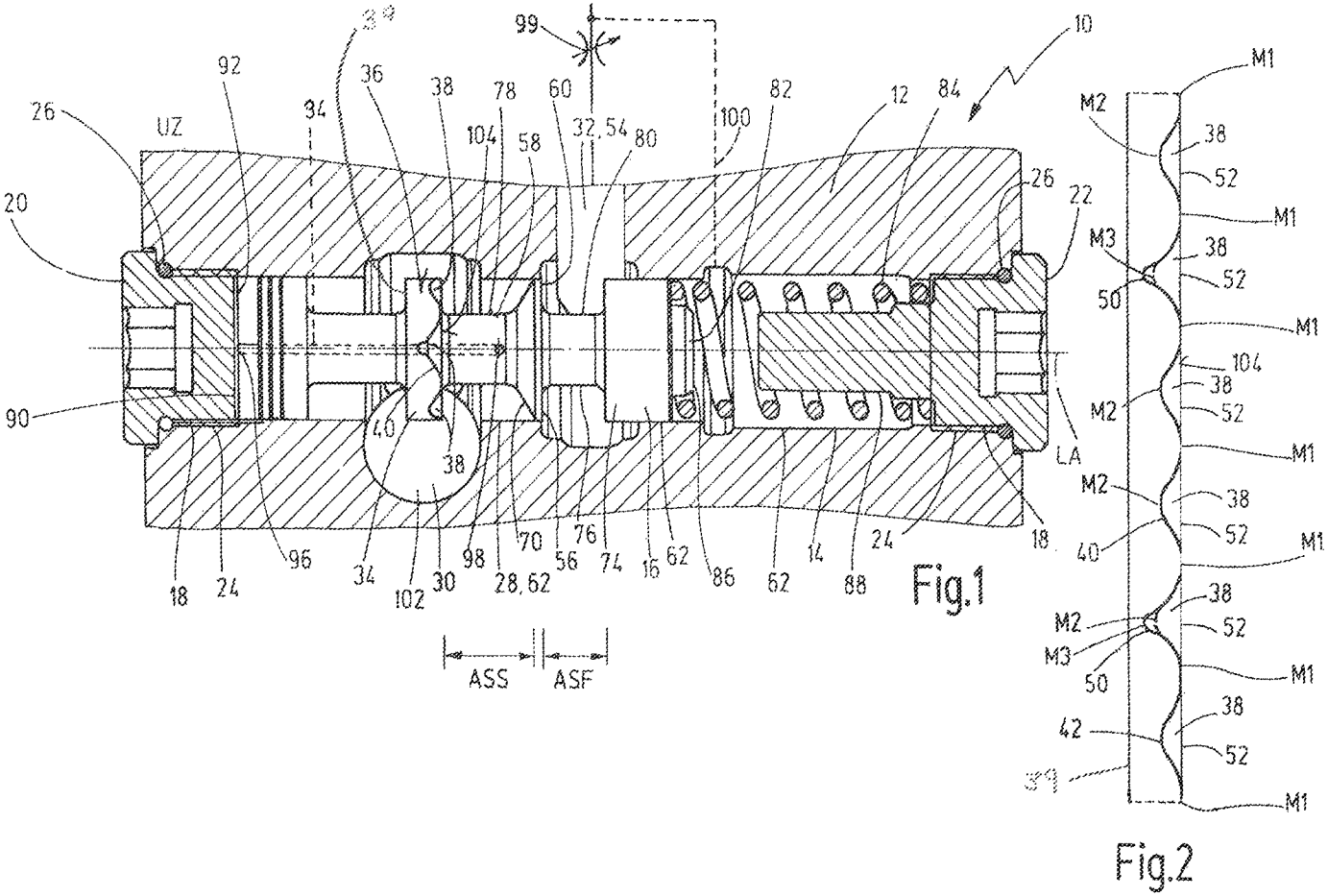
FIG. 1 is a side view in section through a part of a valve, in particular a pressure maintenance valve, with three valve components constructed differently according to an exemplary embodiment of the invention.
FIG. 2 is an end view of an unwound illustration of the outer periphery of the first control part.

A part of a valve structure 10, in particular a pressure maintenance valve structure, is illustrated in FIG. 1. A valve housing 12 has a valve bore 14, in which a valve slide 16 is arranged and is movably guided in a longitudinal direction. The valve bore 14 is closed at both ends 18 by cap screws 20, 22, with each cap screw engaged in an allocatable female thread 24 of the valve bore 14. Provision is made of annular sealing elements 26 between each of the cap screws 20, 22 and the valve housing 12.

Figure 3:
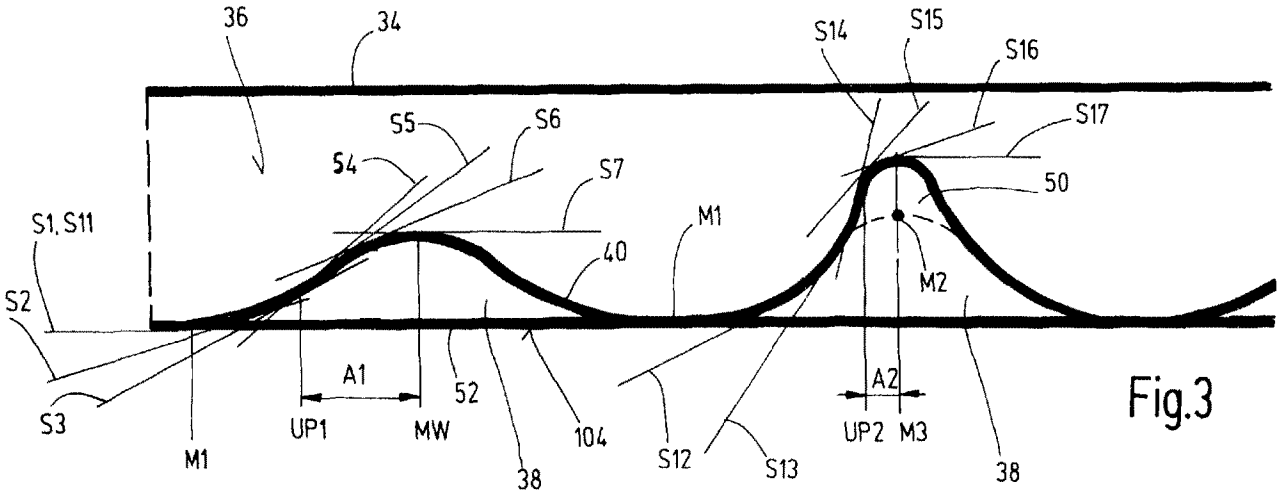
FIG. 3 is a figurative or graphic illustration of a magnified section from FIG. 2.

The valve slide 16 is provided for controlling a fluid-conducting connection 28 between at least two fluid connection points 30, 32 accommodated in the valve housing 12. The valve slide 16 has a cylindrical first control part 34, which has pocket-shaped recesses 38 on the outer periphery 36 (also see FIG. 2 and FIG. 3) and on an axially facing first surface of control part 34 and which has an axially facing second surface 39 opposite the first surface that is flat. Recesses 38 extend coaxially to the longitudinal axis LA of the valve slide 16 and are bordered by circumferential fluid-guiding surfaces 40, which each extend between vertices (maxima or minima) M1, M2, M3 of the recess 38 and which each extend from one vertex M1; M2, M3 towards the other vertex M2, M3; M1 with an increasing incline or, respectively, with an increasing slope (slope S1=0<slope S2<slope S3<slope S4, or slope S11=0<slope S12<slope S13<slope S14).

According to the invention, starting at a predeterminable distance A1; A2 from the other vertex M2, M3; M1, the fluid-guiding surface 40 extends from its point of greatest slope S4; S14 at reversal points UP1, UP2 with decreasing slope (slope S4>slope S5>slope S6>slope S7=0 or slope S14>slope S15>slope S16>slope S17=0) towards the other vertex M2, M3; M1. The respective fluid-guiding surface 40 thus has, in this respect, a continuous progression and minimal slope (S1, S7; S11, S17), preferably zero, at the respective other vertex M2, M3; M1.

The fluid-guiding surface 40 is configured as a curve and the different gradients S2, S3, S4, S5, S6; S12, S13, S14, S15, S16 between the vertices M1, M2, M3 are formed by a transition at the reversal points UP1, UP2 from a concave to a convex curve progression. A plurality of pocket-shaped recesses 38 are arranged along the outer periphery 36 of the first control part 34 of the valve slide 16 such that the fluid-guiding surfaces 40 form a closed cosine curve progression between the individual vertices M1, M2, M3 along this outer periphery 36. At every third pocket-shaped recess 38, in the region of the vertex M1, a groove-shaped recess 50 connects to the bottom of the pocket-shaped recess 38. The largest opening cross section 52 of the respective pocket-shaped recess 38 is oriented to the fluid connection point 32 serving as the fluid outlet 54 of the valve housing 12. Owing to the groove-shaped recess 50, the control performance of the valve slide 16 is improved as a whole.

Figure 5:
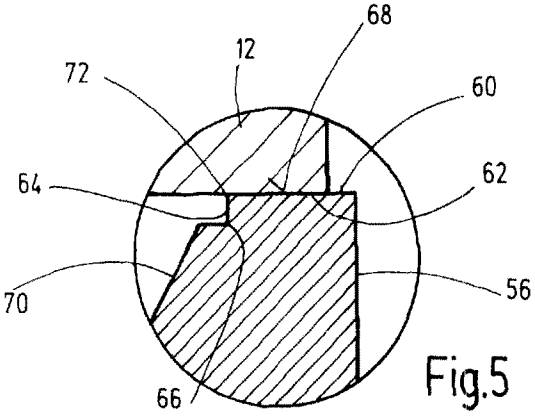
FIGS. 4 and 5 are two detailed and enlarged side views in section of the switching edge extension of the second control part of alternative exemplary embodiments of the invention.
Figure 4:
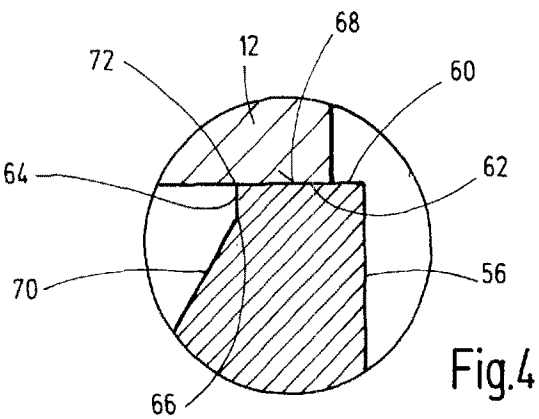

The valve slide 16 has a total of two control parts 34, 56. At least the first control part 34 has the pocket-shaped recesses 38. The second control part 56 is arranged such that it is separated from the first control part 34 by a first fluid guide 58. The second control part 56 is shown in the non-actuated state of the valve slide 16, in other words at zero stroke in the left end position in the plane of the drawing, and in contact with an inner wall 62 of the housing by a cylinder-shaped guide part 60. The guide part 60 has a switching edge surface 64 extending in a step-shaped manner, which faces the first control part 34. The switching edge surface 64 is formed by a reduction 66 in diameter between the outer peripheral side 68 of the guide part 60 and a preferably conically extending transition part 70 of the valve slide 16 in the direction of the first control part 34. The conically extending transition part 70 forms a flow guide for the fluid flowing through the valve component 10 and effects a redirection of the fluid flow in the direction of the fluid outlet 54. It also contributes to flow force compensation. The transition part 70 can transition, either directly at the reduction 66 in diameter (FIG. 4) or via a reduction 66 in diameter in the form of a cut-out (FIG. 5), into the annular surface transverse to the longitudinal axis LA in the form of the switching edge surface 64, which abuts against the switching edge 72 at the outer peripheral side 68 of the cylinder-shaped guide part 60. The switching edge surface 64 is shifted downstream by the cut-out 66 in FIG. 5.

By a second guide part 74, the valve slide 16 is guided through the inner wall 62 of the valve housing 12 in the region of the connection point 32 serving as the fluid outlet 54 in the valve housing 12. A first fluid guide 58 is arranged between the first control part 34 and the second control part 56, holding them apart. A second fluid guide 76 between the second control part 56 and the second guide part 74 improves the flow dynamics of the valve slide 16 in the region of the second control part 56, thereby reducing the pressure losses inside the valve component 10. The second fluid guide 76 furthermore improves the sealing performance of the first guide part 60 with regard to the inner wall 62 of the housing, since the introduction of the second fluid guide 76 into the valve slide 16 enables the sealing gap between the valve slide 16 and the inner wall 62 of the housing to be reduced. The two fluid guides 58, 76, which form axial distances ASS, ASF between the first control part 34 and the second control part 56 as well as between the second control part 56 and the second guide part 74, are obtained by groove-shaped reductions 78, 80 in diameter in the valve slide 16. Such reductions 78, 80 in diameter are also designated as grooves.

The valve slide 16 rests with one of its free front surfaces 82 against an energy storage unit 84 in the form of a compression spring. Guides 86, 88 for the energy storage unit 84 are formed on the valve slide 16 and on the opposite cap screw 22. The valve slide 16 abuts with its other free front surface 90 against a volume space 92 of a variable volume, in which an inner channel 94 of the valve slide 16 opens with one of its ends 96. Its other end 98 opens into the first fluid guide 58 between the two control parts 34, 56, directly adjacent to the transition part 70.

For reproducing the fluid pressure according to at least one pre-adjusted or adjustable measuring orifice 99 on one of the free front surfaces 82 of the valve slide 82, a corresponding fluid channel 100 is provided in the valve housing 12.

Figure 6:
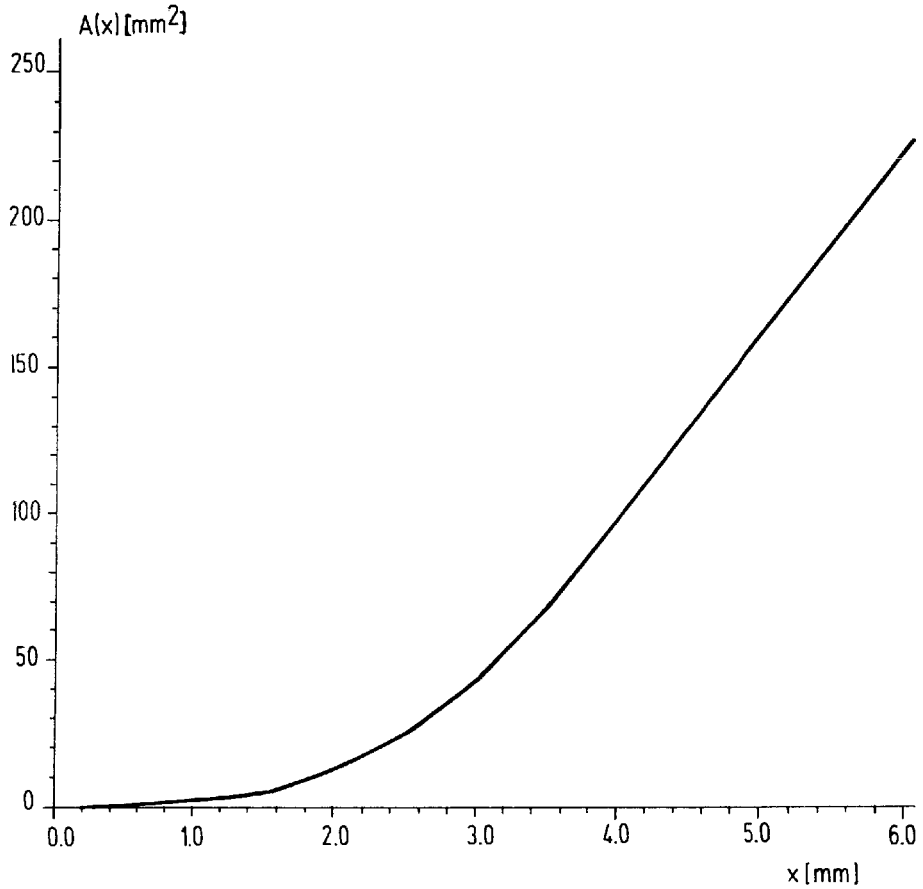
FIG. 6 is a graph plotting the progression of the standard cross section over the opening stroke of the valve slide for the first control part thereof according to the exemplary embodiment of the invention.

The graph of FIG. 6 shows the progression of the standard cross section over the opening stroke. The first guide part 60 is out of contact with the inner wall 62 of the housing after a defined opening stroke. The load holding function is then overcome, and fluid can flow from the fluid connection point 30, which forms the fluid inlet 102, to the fluid connection point 32, which forms the fluid outlet 54. Starting from this opening stroke, the standard cross section increases disproportionately with the increasing opening stroke up to a kink-free transition point, after which the standard cross section increases proportionately to the opening stroke. According to the invention the control accuracy and the stability are improved substantially by a standard cross section that increases monotonically and continuously over the opening stroke without kinks and with a very shallow initial slope.

Consequently, particularly advantages valve components 10 are illustrated by the invention. The pocket-shaped recesses 38 no longer open at an edge, but transition smoothly into the front surface 104 of the first control part 34. The advantage of this structure is that the standard cross section does not change abruptly at an edge. The progression of the standard cross section over the opening stroke therefore has no kink (see FIG. 6). As a consequence, the control accuracy of the valve components 10 is substantially higher and the stability of the control is likewise improved. On the second control part 56, a trailing edge 72, at which the flow surface transitions from an annular switching edge surface 64 extending in the radial plane into an outer peripheral surface 68 extending coaxially to the longitudinal axis LA of the valve slide 16, is provided. A load holding function is achieved in a particularly favorable manner by the switching edge surface 64 extending in a step-shaped manner. This step-shaped manner prevents fluid from flowing against the normal flow direction from the fluid outlet 54 to the fluid inlet 102. Lastly, the additional fluid guide 76 advantageously improves the flow dynamics of the second control part 56 and facilitates the retraction of the valve slide 16. In addition, the sealing gap between the first guide part 60 and the inner wall 62 of the housing is reduced in an advantageous manner.

While various embodiments have been chosen to illustrate the invention, it will be understood by those skilled in the art that various changes and modifications can be made therein without departing from the scope of the invention as defined in the claims.

The invention claimed is:

1. A pressure maintenance valve component, comprising:

a valve housing having first and second fluid-conducting connection points in said valve housing;

a valve slide movably guided in a longitudinal direction in said valve housing; and a first control part on said valve slide, said first control part having a first pocket-shaped recess at least partially bordered by a fluid-guiding surface, said recess having first and second vertices, said fluid-guiding surface extending between said first and second vertices of said recess and having a slope decreasing from said second vertex to said first vertex starting from a predeterminable distance from said second vertex at a point of said fluid-guiding surface having a greatest slope thereof, said fluid-guiding surface extending from said first vertex to said second vertex only and continuously having a decreasing slope along an entire extent thereof from the predetermined distance from said second vertex at the point of greatest slope to said first vertex.

2. A pressure maintenance valve component according to claim 1 wherein said fluid-guiding surface has a continuous progression and a minimal slope at said second vertex.

3. A pressure maintenance valve component according to claim 2 wherein said minimal slope is zero.

4. A pressure maintenance valve component according to claim 1 wherein said fluid-guiding surface has a curved configuration and has different gradients between said first and second vertices formed by transitions from a concave curve progression to a convex curve progression.

5. A pressure maintenance valve component according to claim 1 wherein a plurality of pocket-shaped recesses have same configurations as said first pocket-shaped recess and are arranged along an outer periphery of said first surface of said first control part on said valve slide, fluid-guiding surfaces of said plurality of pocket-shaped recesses extending between first and second vertices of said plurality of pocket-shaped recesses forming at least one of a closed sine or cosine curve progression along said outer periphery.

6. A pressure maintenance valve component according to claim 5 wherein a groove-shaped recess in only selected ones of said pocket-shaped recesses along a repeating pattern, each said groove-shaped recess being in a floor of the respective pocket-shaped recess in a region of said second vertex thereof and deviating from said closed sine or cosine curve progression.

7. A pressure maintenance valve component according to claim 5 wherein each of said pocket-shaped recesses has a largest opening cross section thereof oriented to said second fluid-conducting point serving as a fluid inlet of said valve housing.

8. A pressure maintenance valve component according to claim 1 wherein said first pocket-shaped recess is on an axially facing first surface of said control part; and an axially facing second surface on said control part opposite said first surface is flat.

* * * * *